United States Patent [19]

Rubin et al.

[11] Patent Number: 4,796,033

[45] Date of Patent: Jan. 3, 1989

[54] HUB AND RIM REFLECTOR

[75] Inventors: Charles P. Rubin, Culver City; Thomas A. Bockrath, Hawthorne, both of Calif.

[73] Assignee: Hughes Aircraft Company, Los Angeles, Calif.

[21] Appl. No.: 63,347

[22] Filed: Jun. 18, 1987

[51] Int. Cl.[4] ..... H01Q 15/14

[52] U.S. Cl. ..... 343/912; 343/915; 343/916

[58] Field of Search ..... 343/912, 915, 916, DIG. 2, 343/897

[56] References Cited

U.S. PATENT DOCUMENTS 4,030,102 6/1977 Kaplan et al. ..... 343/DIG. 2
4,378,560 3/1983 Khorsand ..... 343/912
4,527,166 7/1985 Luly ..... 343/915
4,558,551 12/1985 Sevelinge et al. ..... 343/915

*Primary Examiner*—William L. Sikes
*Assistant Examiner*—Hoanganh Le
*Attorney, Agent, or Firm*—S. M. Mitchell; M. J. Meltzer; A. W. Karambelas

[57] ABSTRACT

A non-furlable paraboloidal radio frequency reflector (10) is formed of a mesh-like flexible reflective surface (18) supported by a central hub (12) and a peripheral rim (14). The hub and rim are interconnected by flexible spoke-like structural cables (16, 24) acting in tension to establish the desired spatial relationship. Reflector surface-positioning cables (20, 26) are secured at their ends to the hub, rim or structural cables and are further secured to the reflector surface at points of intersection (22) therewith intermediate their ends to thereby establish an approximation of the desired curved shape of the reflector surface.

12 Claims, 1 Drawing Sheet

HUB AND RIM REFLECTOR

BACKGROUND OF THE INVENTION

This invention relates to radio frequency reflectors, and more particularly to UHF frequency transmitters or antennas of the non-furlable type intended for use in the environment of space.

An important attribute of products intended for use in space is that they be light in weight, to minimize the fuel required to transport them there from the surface of the earth. However, sufficient strength and rigidity must still be provided to maintain the required shape of the reflecting surface.

It is known to utilize perforate or mesh-like reflective surfaces for minimization of weight and solar pressure effects. It is also known to utilize wires or cables as part of the support structure interconnecting a reflector surface-supporting hub and rim. An example of such a prior art reflector is found in U.S. Pat. No. 4,030,102. However, in that prior patent, the antenna is of the deployable type wherein, once deployed or unfurled, the reflector surface is comprised of a series of flat sector-like segments, each defined by straight-line edges at the outer perimeter and along two angularly-spaced radial lines. Thus, there is no means for defining or approximating a reflector surface of paraboloidal shape. For higher frequency transmissions, it is more critical that the shape of the reflector surface more closely approximates the mathematically predetermined curved shape.

Accordingly, it is a principal object of the present invention to provide a lightweight reflector for reflecting radio waves in the environment of space, which reflector has a curved reflective surface capable of approximating a predetermined curved shape, and supported by a lightweight structure capable of maintaining such shape.

SUMMARY OF THE INVENTION

The reflector of the present invention comprises a central hub surrounded by a rigid peripheral rim, with the hub and rim being maintained in their desired relationship by means of light but strong flexible cables acting in tension between the hub and rim. The space between the hub and rim is spanned by a flexible, mesh-like reflective surface which passes behind one axial end of the hub and is secured at its outer perimeter to the rim. The reflective surface is caused to approximate a predetermined curved shape by a plurality of connection points between the reflector surface and the points of intersection between such surface and the cables which pass through the mesh material intermediate the end connections of the cables.

DETAILED DESCRIPTION OF THE PREFERRED EMBODIMENT

The reflector 10 of the present invention generally comprises a central cylindrical hub 12 which functions as central support and is connected to a cylindrical rim 14 by means of a series of diagonal structural cables 16. For maximum strength-to-weight ratio, the hub and rim may be formed of thin-walled plastic panels such as Kevlar 49 or fiberglass, while the cables may be formed of any high tensile strength but lightweight plastic material such as Kevlar 29. These materials are only exemplary, it being understood that the materials should have the indicated physical properties. One well-known form of construction providing maximum strength-to-weight ratio is a honeycomb structure.

Figure 1:
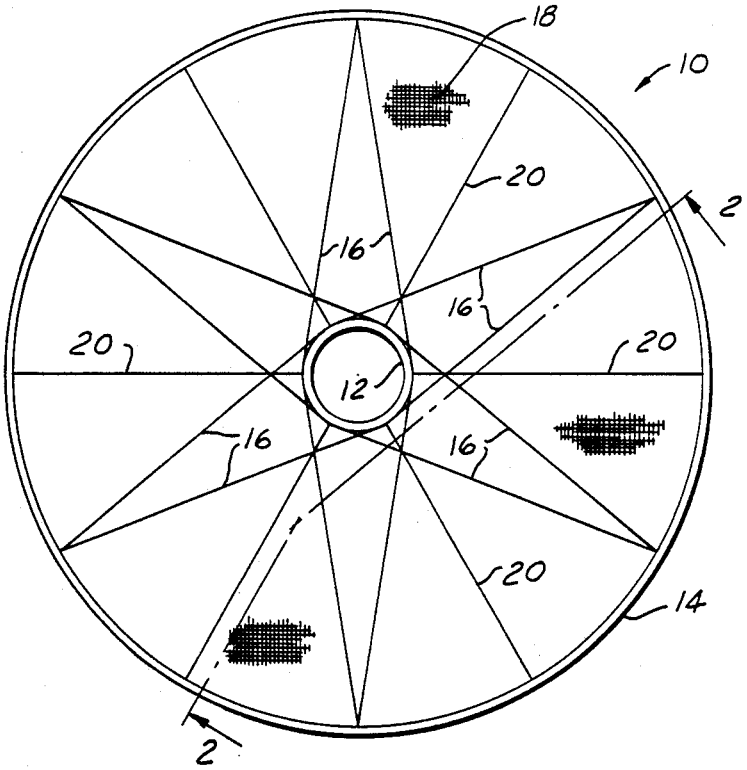
FIG. 1 is a front view of the reflector, viewed along a line parallel to the axis of the hub and rim.
Figure 2:
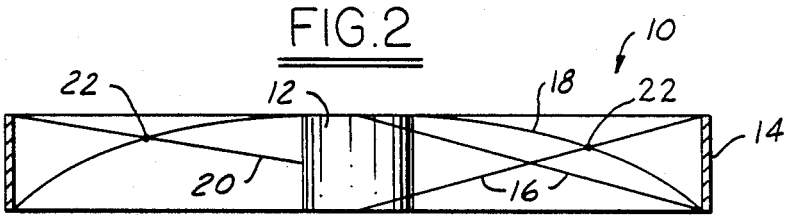
FIG. 2 is a simplified side view, in cross-section, of the reflector of FIG. 1, viewed in the direction of arrows 2—2 of FIG. 1.

As best shown in FIGS. 1 and 2, the ends of diagonal structural cables 16 are secured at their tangential point of connection to hub 12 and to the inner face of rim 14. For maximum axial, radial and torsional rigidity of the assembly, it is preferred that structural cables 16 be arranged in diagonal pairs intersecting opposite axial ends of the hub and rim. In the illustrated example, twelve pairs of cables 16 have been shown. However, as will be understood by those skilled in the art, additional cables may be added if further rigidity is required. The attachment of the cable ends may be by mechanical fastener or adhesive.

Reflecting surface 18, shown fragmentarily in FIG. 1, comprises a flexible mesh-like material which is arranged in a generally paraboloidal shape, with its apex passing around one axial end of hub 12 and its perimeter connected to the opposite axial end of rim 14. The predetermined curved shape of reflector surface 18 is established by connections between the surface and predetermined points of intersection with structural cables 16 and supplementary radially arranged mesh positioning cables 20. The number and angular spacing of positioning cables 20 is determined by the desired degree of conformance between the curve-approximating shape of the reflecting surface 18 and the ideal mathematically-derived curved shape. The points of connection are determined mathematically to best approximate the ideal radio wave-focusing shape. It will be appreciated by those skilled in the art that the degree of conformance will increase as the number of cables (and therefore connection points) is increased. Connection points between each of a radial positioning cable 20 and a diagonal structural cable 16 and reflector surface 18 ae shown at 22 in FIG. 2.

The connections between the reflector surface and the cables may be established by a variety of means, including tying with cord, bonding with adhesive, or a mechanical connector. One of the advantages of using a mesh-like reflector surface, in addition to weight reduction and reduced frontal area exposed to solar pressure, is that the various structural and positioning cables can pass directly through the perforations of the reflector surface.

Figure 3:
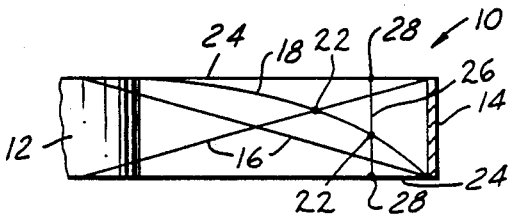
FIG. 3 is a fragmentary cross-sectional view, similar to FIG. 2, showing additional optional structural elements.

In the fragmentary view of FIG. 3, there is shown an alternative embodiment which incorporates additional optional cables. These include a series of horizontal cables 24, which may be angularly aligned with diagonal cables 16 when viewed along the reflector axis, these being tangentially connected to hub 12 at one end and to the inner surface of rim 14 at the other end. As seen in FIG. 1, the diagonal cables 16, positioning cables 20, and horizontal cables 24 may of a wheel. A series of optional vertical positioning cables 26, arranged parallel to the axis of the reflector, spans between connection points 28 on horizontal positioning cables 24. While horizontal cables 24 are like spokes provide additional stiffness to the reflector assembly a principal purpose is to provide additional reflector surface shape-defining connection points 22 with vertical positioning cables 26.

The hub 12 should be formed of a material which is transparent to radio frequency waves, so as not to interfere with full use and benefit of reflecting surface 18. By way of example, the dimensions of reflector 10 can be twelve feet in diameter or more, with the hub being two to four feet in diameter. The structural cables 16 may have a diameter of one-tenth of an inch or less. While hub and rim 12 and 14, respectively, have been illustrated as being cylindrical, it will be understood that they may be formed of polygonal shape as well.

While the reflector surface is illustrated as being symmetrically positioned relative to the axis of hub 12, it may be asymmetrically biased toward one side of the axis, so that radio frequency energy does not get blocked by the reflector receiver point or antenna feed point. In such arrangement, the perimeter of reflector surface 18 would intersect the rim at varying points along the axial length of the rim.

This invention may be further developed within the scope of the following claims. Accordingly, the foregoing specification is to be interpreted as illustrative of only a few operative embodiments of the present invention, rather than in a strictly limited sense.

We now claim:

1. A lightweight reflector for reflecting radio waves comprising:

a centrally located support means and a rigid peripheral rim surrounding and radially spaced from said support means;

a plurality of spoke means having their respective ends secured to a tangential point on said support means and to a point on said rim and acting in tension to maintain said support means and said rim in a predetermined spatial relationship;

a flexible radio frequency wave-reflecting surface constrained by said support means and said rim and by supplementary retaining means to maintain an approximation of a predetermined curved shape, said reflecting surface having an apex portion fastened behind and secured to one axial end of said support means and having an outer perimeter secured to said rim;

said supplementary retaining means comprising points of attachment between said spoke means and said reflecting surface at points intermediate said support means and said rim.

2. The reflector of claim 1 wherein said spoke means comprise structural cables.

3. The reflector of claim 1 wherein said supplementary retaining means comprise positioning cables.

4. The reflector of claim 1 wherein said reflecting surface is formed of a mesh-like material.

5. The reflector of claim 4 wherein said supplementary retaining means comprise positioning cables connected at their respective ends to said support means and said rim, said positioning cables intersecting and passing through said reflecting surface and secured thereto at the points of intersection.

6. The reflector of claim 4 wherein said supplementary retaining means comprise positioning cables connected at their respective ends to said spoke means, said positioning cables intersecting and passing through said reflecting surface and secured thereto at the points of intersection.

7. The reflector of claim 2 wherein said structural cables extend from one axial end of said support means to the opposite axial end of said rim.

8. A lightweight reflector for reflecting radio waves comprising:

a centrally-located hub and a rigid peripheral rim surrounding and radially spaced from said hub;

a plurality of structural cables having their respective ends secured to a tangential point on said hub and to a point on said rim and acting in tension to maintain said hub and said rim in a predetermined spatial relationship;

a flexible mesh-like radio frequency wave-reflecting surface having an apex portion passing around and secured to one axial end of said hub and having its outer periphery secured to said rim;

said reflecting surface being maintained in an approximation of a predetermined curved shape by a plurality of positioning cables, each of which is secured to said reflecting surface and to at least one of said hub, said rim, and said structural cables.

9. The reflector of claim 8 wherein said positioning cables pass through said reflecting surface at their respective points of attachment thereto, the ends of each of said positioning cables being secured to said hub and said rim.

10. The reflector of claim 8 wherein said positioning cables pass through said reflecting surface at their respective points of attachment thereto, the ends of each of said positioning cables being secured to said structural cables.

11. The reflector of claim 8 wherein said hub and said rim each comprise a thin-walled cylindrical structure, and wherein said structural cables includes diagonal cables interconnecting opposite axial ends of said hub and rim.

12. A method of forming a radio frequency reflector comprising:

interconnecting a substantially rigid central supporting structure with a substantially rigid peripheral rim, which surrounds and is radially spaced from said central supporting structure, by means of a plurality of spoke means between tangential points on said hub and points on said rim and which act in tension to maintain said central supporting structure and rim in a predetermined spatial relationship;

connecting the perimeter of a flexible mesh-like reflective material to said rim, a central portion of said reflective material passing around one axial end of said central supporting structure;

at least some of said spoke means passing through the mesh openings in said reflective material at predetermined points along the lengths of said spoke means and being connected to said reflective material at said points, said points being located to cause said reflective material to assume an approximation of a predetermined curved shape.

* * * * *

UNITED STATES PATENT AND TRADEMARK OFFICE

CERTIFICATE OF CORRECTION

PATENT NO. : 4,796,033

DATED : January 3, 1989

INVENTOR(S) : C. P. RUBIN et al.

It is certified that error appears in the above—identified patent and that said Letters Patent is hereby corrected as shown below:

Column 2, line 49, delete "ae" and insert --are--;

line 68, delete "may" and insert --are like spokes--.

Signed and Sealed this

Thirtieth Day of May, 1989

*Attest:*

*Attesting Officer*

DONALD J. QUIGG

*Commissioner of Patents and Trademarks*